United States Patent [19]

Abduganiev et al.

[11] 4,351,149

[45] Sep. 28, 1982

[54] SPINDLELESS SPINNING MACHINE

[76] Inventors: Abdurakhim Abduganiev, Chilanzar, D-20, 33, kv. 7, Tashkent; Timur P. Krjuk, prospekt Mira, 90, kv. 11, Moscow; Vitaly I. Zhestkov, Chilanzar, kvartal 19, 26, kv. 41, Tashkent; Valentin N. Tikhonov, ulitsa Sh.Rustaveli, 55, kv.28, Tashkent; Vladimir G. Glazov, Chilanzar, kvartal 19, 26, kv. 23, Tashkent; Mikhail M. Kletny, poselok Pirogovsky, ulitsa Sovetskaya, 7, kv. 70, Moskovskaya oblast; Gennady N. Shlykov, Chilanzar, kvartal 19, 31, kv. 3, Tashkent; Vladimir K. Afanasiev, Golyanovsky proezd, 4, kv. 129, Moscow; Vasily M. Dyachkov, zhiloi massiv Kuiljuk, 23, kv. 11, Tashkent; Gennady V. Zhigalov, ulitsa B. Khmelnitskogo, 68, korpus 2, kv. 68, Tashkent; Rafael A. Mangutov, ulitsa Sh.Rustaveli, 59, kv. 10, Tashkent; Ernst I. Angarov, Serpukhovskoi val, 13a, kv. 4, Moscow, all of U.S.S.R.

[21] Appl. No.: 197,981

[22] PCT Filed: Mar. 13, 1979

[86] PCT No.: PCT/SU79/00013

§ 371 Date: Nov. 13, 1980

§ 102(e) Date: Oct. 22, 1980

[87] PCT Pub. No.: WO80/01925

PCT Pub. Date: Sep. 18, 1980

[51] Int. Cl.[3] ..... D01H 15/00

[52] U.S. Cl. ..... 57/263; 57/404

[58] Field of Search ..... 57/58.89, 58.95, 263

[56] References Cited

U.S. PATENT DOCUMENTS

| | | | |
|---|---|---|---|
| 3,952,491 | 4/1976 | Sharychenkov | 57/58.95 X |
| 4,107,957 | 8/1978 | Stahlecker et al. | 57/263 |
| 4,137,699 | 2/1979 | Stahlecker et al. | 57/263 X |
| 4,175,370 | 11/1979 | Stahlecker | 57/263 |

*Primary Examiner*—Donald Watkins

*Attorney, Agent, or Firm*—Steinberg & Raskin

[57] ABSTRACT

The machine has a framework (1) with a rotation drive, spinning stations, a yarn withdrawal unit (2) and yarn winding devices (3) disposed thereon. Each spinning station comprises a fibres feed unit (4) and a spinning chamber (5), having a housing (14) installed on the framework (1) so that it can be withdrawn from the fibres feed unit (4). The yarn withdrawal unit (2) comprises a driving shaft (22) mounted on the framework (1), and pressing rollers (23), which in operating position are resiliently pressed to the driving shaft (22) and can be withdrawn from said driving shaft. Each yarn winding device (3) is mounted at a respective spinning station and comprises a bobbin carrier (27) and a yarn spreader (28). According to the invention each pressing roller (23) is mounted on the housing (14) of the respective spinning chamber (5), and each yarn winding device (3) has operative connection (31) with the housing (14) of a respective spinning chamber (5) to disengage and engage the rotation drive.

6 Claims, 6 Drawing Figures

SPINDLELESS SPINNING MACHINE

TECHNICAL FIELD

The present invention relates to the textile engineering and is specifically concerned with the construction of machines for spindleless spinning.

BACKGROUND ART

Spindleless spinning machines have been known for a relatively long time, but to date the problem of reducing the time necessary for threads carrying, yarn breakage elimination, starting the machine and its separate spinning stations continues to call for solution. It is known that modern spindleless spinning machines have a significant number of spinning stations (200 and more), so the productivity of a machine as a whole depends upon the time necessary for performing the yarn carrying and other auxiliary operations which are to be carried out when starting the machine. It must be for this reason that great attention has been paid to the problem of reducing the time necessary for carrying out auxiliary operations by their partial mechanization and automation when new machines are designed and the old ones are improved.

It should be noted that many auxiliary operations necessary to be carried out when repairing yarn breakage are mechanized in modern spindleless spinning machines. Known in the art is, for instance, a spindleless spinning machine (see the FRG Pat. No. 1,560,313, published on Mar. 4, 1973), which has a framework with spinning stations disposed thereon, each of which has a fibres feed unit and a spinning chamber positioned on the framework and having a forming and twisting rotor with a clamp. In addition, a machine comprises a yarn withdrawal unit which has the form of a pair of rollers, and yarn winding devices. A yarn strain indicator, which is electrically connected with the drive of the fibres feed unit, is in contact with the yarn. When the yarn breakage occurs the indicator sends a control signal and the drive of the fibres feed unit stops. At this very moment the forming and twisting rotor and the drive disengage and a respective yarn winding device stops. To restart the spinning process the yarn is fed from the winding device to the forming and twisting rotor which is brought to rotation. Then the drive of the fibres feed unit is started and the yarn twisting-in is carried out. When the process of twisting-in is over the yarn being withdrawn is directed between a pair of rollers of the yarn withdrawal unit and the spinning process continues.

The obvious advantage of the machine under consideration is the fact that the devices which the machine comprises allow comparatively quick elimination of yarn breakage. However, a timely yarn withdrawal on the completion of the twisting-in process continuous to be a problem, and this causes violation of thickness and uniformity of the structure at a certain length.

Known in the art is also a spindleless spinning machine whose construction was improved to overcome this disadvantage (see Specification to accepted application of FRG Pat. No. 2,429,645, published on Jan. 2, 1976). Said machine has a framework whereon a rotation drive and spinning stations are disposed. Each spinning station comprises a fibres feed unit and a spinning chamber having a housing positioned on the framework. Said housing can be withdrawn from the fibres feed unit. In addition, the machine comprises a yarn withdrawal unit whose driving shaft is installed on the framework, and pressing rollers which, when in operating position, are resiliently pressed to said driving shaft and are mounted in such a way that they can be withdrawn from said driving shaft. Besides the aforementioned units, the machine is provided with yarn winding devices each of which is installed near a respective spinning station and comprises a bobbin carrier and a yarn spreader.

A specific peculiarity of the machine is the fact that the pressing rollers are mounted on turnable levers which are pivotally connected to the framework. When the pivoted levers are in operating position, the pressing rollers are engaged with the driving shaft. If the yarn breakes at some spinning station a respective pivoted lever is turned to a position which allows a pressing roller, mounted thereon, and the driving shaft to disengage. The machine has a yarn strain indicator which sends a control signal to the drive of a brake and of the fibres feed unit.

To engage the pressing roller with the driving shaft a respective lever is manually shifted to the operating position. This allows a timely withdrawal of a yarn on the completion of the twisting-in process and thus preventing violation of thickness and uniformity of the yarn structure. Each bobbin carrier has the form of a pivotal lever and allows manual withdrawal of a package from the yarn spreader when repairing the yarn breakage and then returning it thereto when starting.

Thus the following auxiliary operations are to be performed if it is necessary to repair the yarn breakage and then to start a spinning station: withdrawing the housing of the spinning chamber from the fibres feed unit, withdrawing a package from the yarn spreader, withdrawing the pressing roller from the driving shaft, and returning said elements to the initial position after the yarn twisting-in is over. It is quite obvious that the time necessary to perform these operations limits the productivity of the machine as a whole. It should also be noted that the unproductive time necessary to perform these auxiliary operations in a spinning shop equipped with such machines determines to a great extent the number of the attending personnel. In addition, when the spinning station is being started the synchronism of advancing the yarn withdrawal unit and the package to the yarn spreader is sometimes violated with the result that coils may be formed when the yarn spreader having the form of a conoid drum is used, or the yarn may be broken when a yarn spreader having the form of a traverse is used.

DISCLOSURE OF INVENTION

The object of the invention is to provide a spindleless spinning machine whose construction would make it possible to use a limited number of auxiliary operations when starting and stopping any spinning station, which operations include withdrawing and advancing a housing of a spinning chamber, as well as to provide a synchronous disengaging and engaging a yarn withdrawal unit and a yarn winding device at this spinning station.

The object of the invention is attained by that in a spindleless spinning machine which has a framework whereon are disposed a rotation drive, spinning stations, each of which comprises a fibres feed unit and a spinning chamber having a housing which is installed in the framework and which can be withdrawn from the fibres feed unit, as well as a yarn withdrawal unit whose driving shaft is installed on the framework and the pressing rollers resiliently pressed to the driving shaft when in operating position and mounted in such a way that they can be withdrawn from said driving shaft, and yarn winding divices each of which is installed at a respective spinning station and comprises a bobbin carrier and a yarn spreader, in accordance with the invention, each pressing roller is, mounted on the housing of a respective spinning chamber, and each yarn winding device is operatively connected with the housing of a respective spinning chamber for disengaging and engaging the rotation drive.

Such an arrangement of the machine makes it possible to perform, in the process of the yarn breakage repair at some spinning station, only such auxiliary operations as withdrawing and advancing the housing of the spinning chamber, while the operations of starting and stoping the yarn withdrawal unit and the yarn winding device are performed automatically, simultaneously with carrying out said auxiliary operations.

It is quite obvious that this makes the machine servicing easier and simpler, improved productivity of the machine and allows reduction of the number of the attending personnel. In addition, synchronous starting the yarn withdrawal unit and the yarn winding device allows providing the same yarn properties and quality both during a starting period and during a period of machine operation.

It is advisable that each pressing roller be mounted on the housing of the respective spinning chamber by means of a spring-loaded lever, whose one end is pivotally connected to the housing of the spinning chamber and the other end carries the axle of the pressing roller. Such arrangement of the pressing roller is very simple from a constructive point of view, while it allows, if necessary, adjusting in a wide range the force of the roller pressing to the driving shaft.

It is advisable that each bobbin carrier have the form of a pivoted lever resiliently pressed in the direction of the yarn spreader with the package axle mounted on the free end thereof, and a pivotal double-arm lever be installed on the framework in the interspace between each spinning chamber and each bobbin carrier. One arm of the double-arm lever is in contact with the bobbin carrier and the other arm, with a respective spinning chamber to withdraw a package from the yarn spreader when the housing of this spinning chamber is being withdrawn to inoperative position. Such modification is preferable if traverses or conoid drums having their own drives are used as yarn spreaders.

The most simple, from a constructive point of view, is a double-arm lever which has the form of a V-shape rocker.

It is expedient that each pressing roller, in case a conoid drum not having its own drive is used as the yarn spreader, be mounted in a way which would provide its friction contact with the yarn spreader in operating position. This modification allows replacement of any conoid drum without stopping the whole machine, if necessary.

It is expedient that each pressing roller have rims and the driving shaft have the circular recesses in which rims of the pressing rollers are introduced when in operating position. This makes it possible to provide necessary yarn strain within the section from the yarn withdrawal unit to the yarn winding device owing to the difference of the linear speeds and contributes to more dense winding of the package.

BEST MODE FOR CARRYING OUT THE INVENTION

Figure 1:
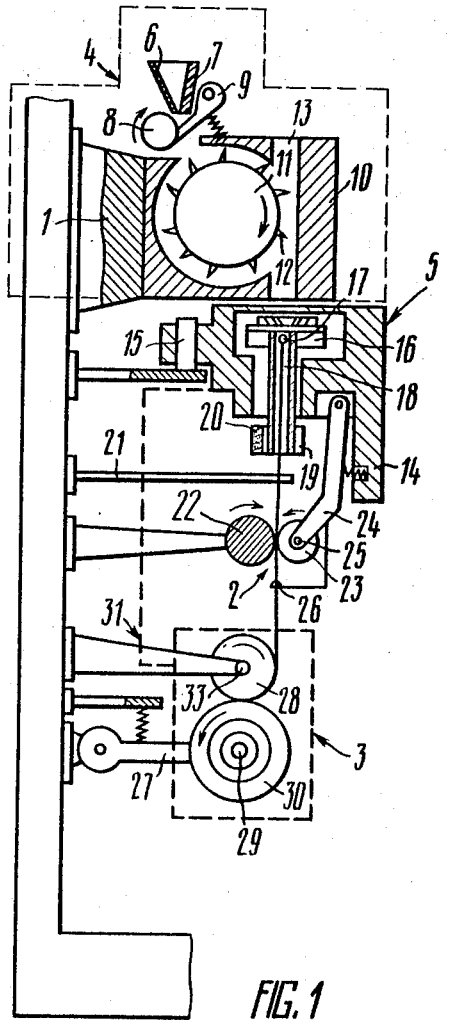
FIG. 1 shows a principle diagram of the spindleless spinning machine, according to the invention.

A spindleless spinning machine, as it is shown in FIG. 1 of the accompanying drawings, has a framework 1 whereon are disposed spinning stations, a yarn withdrawal unit 2 and yarn winding devices 3 and a rotation drive (not shown in the drawing). Each spinning position comprises a fibres feed unit 4 and a spinning chamber 5. The fibres feed unit 4 comprises a sliver container with guiding walls 6 and 7. A feeding roller 8 and a spring-loaded pressing plate 9 are mounted at the outlet portion of the fibres feed unit 4. In a housing 10 of the fibres feed unit 4, a discreting drum 11 with teeth 12 is installed. An outlet port 13 is formed in the housing 10.

The spinning chamber 5 has a housing 14 which is installed on the framework 1 by means of a cylindrical pivot 15. Said housing 14 can be withdrawn from the fibres feed unit 4. A forming and twisting rotor 16 with a ball clamp 17 is positioned in the housing 14 of the spinning chamber 5. An inlet opening 18, which matches the outlet port 13 of the fibres feed unit 4 when in operating position, is formed in the housing 14 of the spinning chamber 5. The forming and twisting rotor 16 has a tubular stem 19 which is in contact with a drive belt 20 when the spinning chamber 5 is operating position. A yarn strain indicator 21, which is electrically coupled with a drive (not shown in the drawing) of the fibres feed unit 4, is installed at the outlet portion of the spinning chamber 5.

The yarn withdrawal unit 2 comprises a driving shaft 22, mounted on the framework 1, which passes via all spinning stations of the machine and is connected with the rotation drive (not shown in the drawing). The yarn withdrawal unit 2 also comprises pressing rollers 23, each of which is resiliently pressed to the driving shaft 22. Each pressing roller 23 is mounted, in this particular case, according to the invention, on the housing 14 of the spinning chamber 5 in a way, allowing it to be withdrawn from said driving shaft 22. In particular, the pressing roller 23 is mounted on the housing 14 of the spinning chamber 5 by means of a spring-loaded lever 24. One end of the spring-loaded lever is pivotally connected to the housing 14 of the spinning chamber 5, and the other end carries an axle 25 of the pressing roller 23. A yarn director 26 is fixed on the same spring-loaded lever 24.

Each yarn winding device 3 is positioned at a respective spinning station of the machine and comprises a bobbin carrier 27 and a yarn spreader 28. All yarn spreaders 28 are connected with the rotation drive (not shown in the drawing). Each bobbin carrier 27 has an axle 29 for placing a package 30. It is quite obvious that the construction of the yarn spreader 28 can vary. It can, for instance, have a form of a traverse, however, an alternative embodiment wherein the yarn spreader 28 has the form of a conoid drum, will be further explained. Each bobbin carrier 27 of the yarn winding device 3 has the form of a resiliently pressed in the direction of the yarn spreader 28 pivotal lever with the axle 29 mounted on the free end thereof.

According to the invention, each yarn winding device 3 has an operative connection 31 with the housing 14 of a respective spinning chamber 5, designed to engage and disengage said device with the rotation drive (not shown in the drawing). The construction of the operative connection 31 can vary. Two following modifications of the machine are preferable: with a link operative connection and with a friction operative connection.

Figure 2:
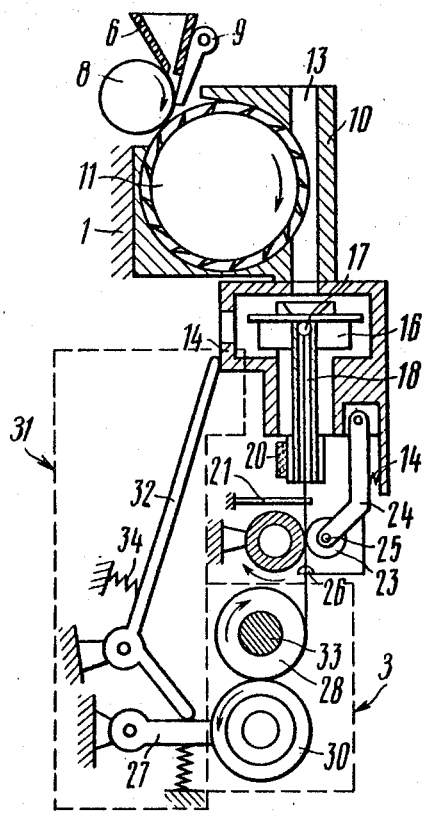
FIG. 2 shows a modification of the machine with link operative connection in operating position, according to the invention.

In the modification of the machine shown in FIG. 2 of the accompanying drawings the operative connection 31 of the yarn winding device 3 with the housing 14 of the spinning chamber 5 is a link one.

Figure 3:
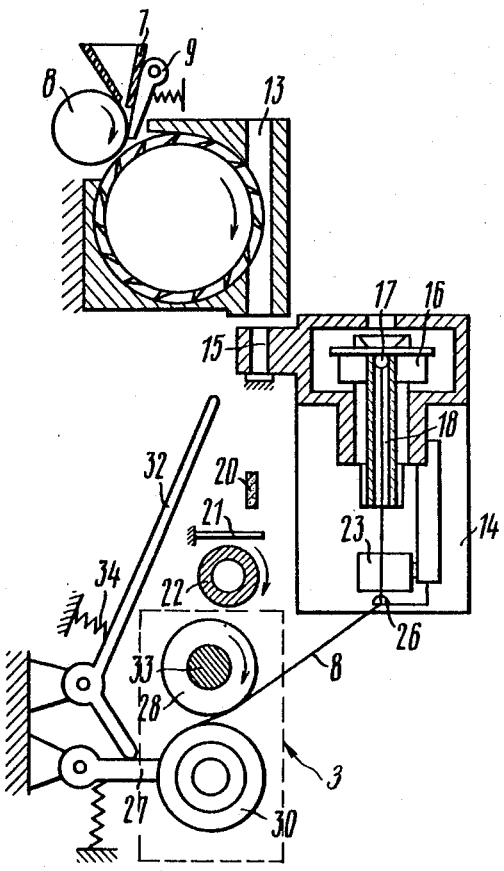
FIG. 3 shows a modification of the machine shown in FIG. 2 in inoperative position.

According to the invention, a pivotal double-arm lever 32 is installed on the framework 1 in the interspaces between each spinning chamber 5 and each bobbin carrier 27. One arm of the pivotal double-arm lever 32 is in contact with the bobbin carrier 27, and the other arm is in contact with the housing 14 of a respective spinning chamber 5. All yarn spreaders 28 are connected with the rotation drive (not shown in the drawing) by a common shaft 33. The pivoted double-arm lever 32 has, according to the invention, a form of a V-shape rocker and is resiliently pressed by a spring 34 to the bobbin carrier 27. One arm of the pivotal double-arm lever 32 is in contact with the housing 14 of the spinning chamber 5, provided the housing 14 is in operating position, and gets out of contact with this housing 14 when the latter turns to inoperative position. This is well shown in FIG. 3 of the accompanying drawings.

Figure 4:
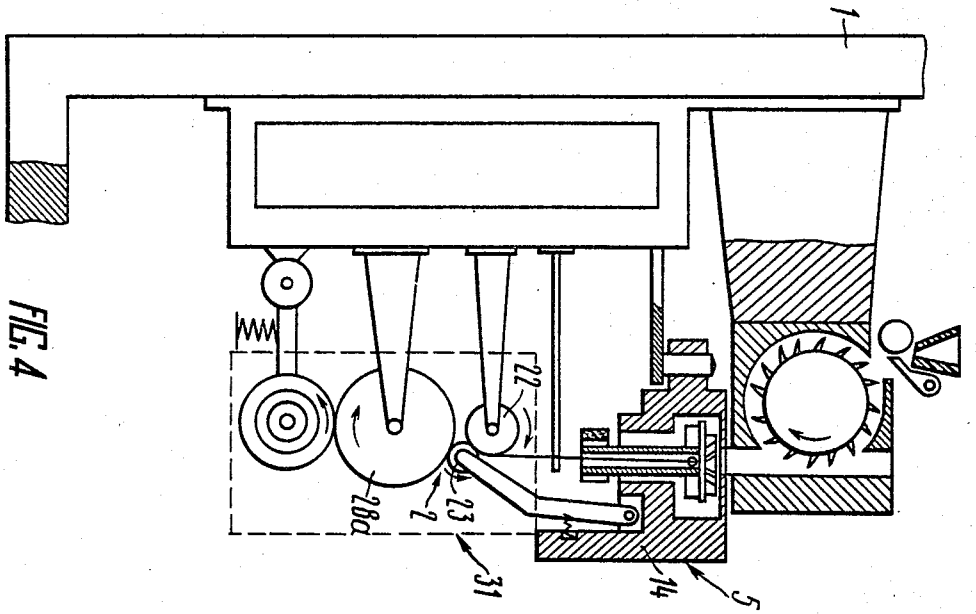
FIG. 4 shows a modification of the machine with a friction operating connection in operating position, according to the invention.
Figure 5:
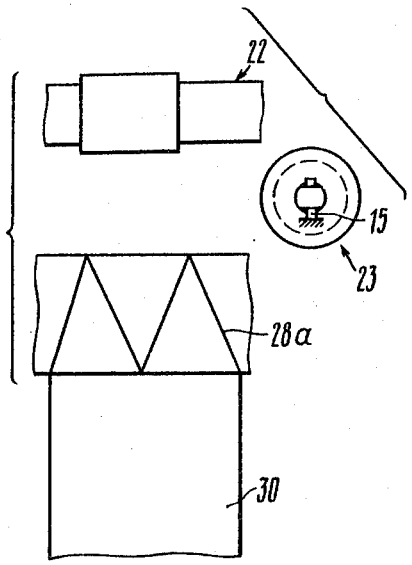
FIG. 5 shows a modification of the machine shown in FIG. 4 when in inoperative position.
Figure 6:
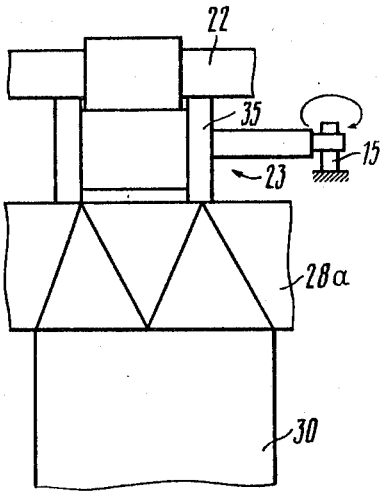
FIG. 6 shows a portion of the driving shaft and a pressing roller of the modification shown in FIG. 4, according to the invention.

FIG. 4 of the accompanying drawings shows a modification of the spindleless spinning machine, wherein the yarn winding device has a friction operative connection 31 with the housing 14 of the spinning chamber 5. This modification is advisable when a conoid drum **28*a* is used as the yarn spreader. In this case each pressing roller 23 is mounted in a way allowing it to have, when in operating position, a friction contact with the conoid drum 28*a*. Thus, the yarn winding device is connected with the rotation drive (not shown in the drawing) via the pressing roller 23, fixed on the housing 14, and the driving shaft 22. As it is well shown in FIG. 5 of the accompanying drawings, the pressing roller 23, when in inoperative position, is withdrawn and has no a friction contact with the drum 28*a*. For the purpose of providing a dense winding each pressing roller 23 has rims 35, and the driving shaft 22 has circular recesses. (See FIG. 6 of the accompanying drawings). The rims 35 of the pressing roller 23 are introduced into circular recesses of the driving shaft 22**.

The spindleless spinning machine under consideration operates as follows.

At each spinning station a fibrous sliver is fed via the sliver contained to the fibres feed unit 4 and then it is fed by the feed roller 8 to the discreting drum 11. The discreting drum 11 being rotated, combs a fibrous sliver with its teeth 12 and breaks bonds existing between fibres. The produced discrete fibres are fed in a continuous flow fia the outlet port 13 and the inlet opening 18 to the spinning chamber 5. The forming and twisting rotor 16, rotating under the action of the driving belt 20, densifies the fibres and forms a strand. The strand, having passed the ball clamp 17, twists and forms a yarn. The produced yarn is withdrawn from the spinning chamber 5 by the driving shaft 22 and the pressing roller 23, the indicator 21 continuously controlling the yarn strain. Then the produced yarn is fed to the yarn winding device 3 and is wound into the package 30.

If the yarn breaks, the yarn strain indicator 21 disengages the drive (not shown in the drawing) of the fibres feed unit 4 and a spinning process at a certain spinning station stops. To eliminate yarn breakage, the housing 14 of the spinning chamber 5, is turned around the cylindrical pivot 15 to be withdrawn from the fibres feed unit 4. Simultaneously with the withdrawal of the housing 14, the operative connection 31 disengage the yarn winding device 3 from the rotation drive (not shown in the drawing). Then the end portion of the yarn is introduced from the package 30 via the director 26 into the spinning chamber 5 and is fixed by the ball clamp 17. This done, the housing 14 is turned to the operating position. While the housing 14 is being turned, the pressing roller 23 entraps the yarn which enters the zone of action of the strain indicator 21. The yarn strain indicator 21 sends a control signal and engages the drive (not shown in the drawing) of the fibres feed unit 4. Simultaneously the pressing roller 23 begins to interact with the driving shaft 22 and a uniform withdrawal of the yarn being twisted in is carried out. At the moment when the housing 14 returns to the operating position, the operative connection 31 engages, the yarn winding device 3 is coupled with the rotation drive (not shown in the drawing) and the yarn starts to wind into the package 30 synchronously with its withdrawal.

The modification of the machine shown in FIG. 2 of the accompanying drawings operates, when producing the yarn, as described above. When eliminating the yarn breakage, e.g. when stoping and starting a spinning station, the devices are engaged and disengaged as follows. When the housing 14 of the spinning chamber 5 is turned to inoperative position (see FIG. 3 of the accompanying drawings) one arm of the pivotal double-arm lever 32 is no longer supported. The lever 32 actuated by the spring 34 turns, whereby turning with its another arm a bobbin carrier 27 and withdrawing the package 30 from the yarn spreader 28. When the housing 14 returns to the operating position (see FIG. 2 of the accompanying drawings) the lever 32, actuated by said housing 14, turns in the opposite direction, overcoming the force of the spring 34, and the bobbin carrier returns to the initial position thus pressing the package 30 to the yarn spreader 28.

The modification of the machine shown in FIG. 4 of the accompanying drawings operates, when producing a yarn, as described above. When eliminating the yarn breakage, i.e. when stoping and starting a spinning station, the devices are engaged and disengaged as follows.

When the housing 14 of the spinning chamber 5 is turned to inoperative position (see FIG. 5 of the accompanying drawings) the pressing roller 23 is withdrawn from a friction contact with the driving shaft 22 and the yarn spreader 28, thus synchronously stoping the yarn withdrawal and winding due to disengagement of the operative couple, connecting the yarn spreader 28 with the rotation drive (not shown in the drawing). It is quite obvious, that when the housing 14 returns to the operating position (see FIG. 4 of the accompanying drawings) the pressing roller 23, simultaneously entering into friction contact with the driving shaft 22 and the yarn spreader 28, synchronously engages the yarn withdrawal unit 2 and the winding device 3.

When a spinning process is performed, the yarn stretching is carried out within a section extending from the yarn withdrawal unit 2 to the yarn winding device 3. This is attained by that the surface of the pressing roller 23 between the rims 35 enters into a friction contact with the driving shaft 22, and rotation is imparted to the yarn spreader 28 by the rims 35. The yarn stretching and dense winding on the package 30 is achieved owing to the difference between the line speeds at the beginning and end of this section.

Industrial Applicability

The invention may be most efficiently employed in the textile industry in producing yarn from natural, man-made fibres and mixtures thereof, as well as in converting low-grade raw material (for instance: short fibres, fibrous material with foreign impurities, etc.) into yarn by the spindleless spinning technique.

We claim:

1. A spindleless spinning machine, having a framework whereon are disposed a rotation drive, spinning stations each of which comprises a fibres feed unit and a spinning chamber, having a housing which is installed on the framework so that it can be withdrawn from the fibres feed unit, and also a yarn withdrawal unit whose driving shaft is installed on the framework and pressing rollers are in operating position resiliently pressed to the driving shaft and mounted so that they can be withdrawn from said driving shaft, and yarn winding devices, each of which is mounted at a respective spinning station and comprises a bobbin carrier and a yarn spreader, characterized in that each pressing roller (23) is mounted on the housing (14) of a respective spinning chamber (5), and each yarn winding device (3) has an operative connection (31) with the housing (14) of the respective spinning chamber (5) to engage and disengage the rotation drive.

2. The machine as defined in claim 1, characterized in that each pressing roller (23) is mounted on the housing (14) of the respective spinning chamber (5) by a spring-loaded lever (24), whose one end is pivotally connected to the housing (14) of the spinning chamber (5) and the other end carries an axle (25) of the pressing roller (23).

3. The machine as defined in claim 1, characterized in that each bobbin carrier (27) has the form of a pivotal lever, resiliently pressed in the direction of a yarn spreader (28), at the free end of said lever an axle (29) of a package (30) is mounted and on the framework (1) in the interspace between each spinning chamber (5) and each bobbin carrier (28) a pivotal double-arm lever (32) is-installed, one arm of said lever being in contact with the bobbin carrier (27) and the other arm being in contact with the housing (14) of the respective spinning chamber (5) to withdraw the package (30) from the yarn spreader (28) when the housing (14) of this spinning chamber (5) is withdrawn to inoperative position.

4. The machine as defined in claim 3, characterized in that the double-arm pivotal lever (32) has the form of a V-shape rocker.

5. The machine as defined in claim 1, characterized in that when a conoid drum (28) not having its own drive is used as a yarn spreader each pressing roller (23) is mounted so that said roller enters, in operating position, into friction contact with the conoid drum **(28*a*)**.

6. The machine as defined in claim 5, characterized in that each pressing roller (23) has rims (35), and the driving shaft (22) has circular recesses in which the rims (35) of the pressing rollers (23) are introduced in operating position.

* * * * *